US009183844B2

(12) United States Patent
Tennant

(10) Patent No.: US 9,183,844 B2
(45) Date of Patent: Nov. 10, 2015

(54) NEAR-FIELD NOISE CANCELLATION

(75) Inventor: Bryce Tennant, Rochester, NY (US)

(73) Assignee: Harris Corporation, Melbourne, FL (US)

( * ) Notice: Subject to any disclaimer, the term of this patent is extended or adjusted under 35 U.S.C. 154(b) by 647 days.

(21) Appl. No.: 13/477,154

(22) Filed: May 22, 2012

(65) Prior Publication Data

US 2013/0317783 A1 Nov. 28, 2013

(51) Int. Cl.
*G10L 21/0208* (2013.01)

(52) U.S. Cl.
CPC ..... *G10L 21/0208* (2013.01)

(58) Field of Classification Search
CPC ..... H04R 3/005; G01L 21/0208; G01L 21/02085; G10K 1/00; G10K 11/1784; G10K 11/348
USPC ..... 381/71.1, 73.1, 92, 94.1; 455/41.1, 455/63.1; 702/191
See application file for complete search history.

(56) References Cited

U.S. PATENT DOCUMENTS

| | | | | |
|---|---|---|---|---|
| 6,253,763 | B1 * | 7/2001 | Pounders, Jr. | A62B 9/06 128/201.11 |
| 6,611,601 | B2 * | 8/2003 | Terada et al. | 381/66 |
| 6,694,029 | B2 | 2/2004 | Curtis et al. | |
| 6,917,688 | B2 | 7/2005 | Yu et al. | |
| 7,809,559 | B2 * | 10/2010 | Kushner et al. | 704/228 |
| 8,229,126 | B2 * | 7/2012 | Chamberlain | G10K 11/1784 381/57 |
| 2002/0012438 | A1 * | 1/2002 | Leysieffer et al. | 381/312 |
| 2003/0065507 | A1 * | 4/2003 | Gerlach | 704/212 |
| 2005/0031136 | A1 * | 2/2005 | Du | H04R 3/005 381/92 |
| 2006/0009971 | A1 * | 1/2006 | Kushner | G10L 17/26 704/231 |
| 2006/0020451 | A1 * | 1/2006 | Kushner | B63C 11/26 704/226 |
| 2006/0262944 | A1 * | 11/2006 | Rasmussen | G10L 25/78 381/110 |
| 2008/0019538 | A1 * | 1/2008 | Kushner et al. | 381/94.1 |
| 2008/0118082 | A1 | 5/2008 | Seltzer et al. | |
| 2008/0306733 | A1 | 12/2008 | Ozawa | |

(Continued)

FOREIGN PATENT DOCUMENTS

WO 2010104995 A2 9/2010

OTHER PUBLICATIONS

International Search Report mailed Jul. 30, 2013, Application Serial No. PCT/US2013/041551, in the name of Harris Corporation.

(Continued)

*Primary Examiner* — John Breene
*Assistant Examiner* — Jeffrey Aiello
(74) *Attorney, Agent, or Firm* — Robert J. Sacco, Esq.; Carol E. Thostad-Forsyth; Fox Rothschild LLP

(57) ABSTRACT

Systems and methods for cancelling a near-field noise signal. The methods generally involve: receiving (604), from a first acoustic sensing device (120), a first signal (214) comprising a near-field noise signal (206); synthesizing (320, 420, 520, 606) a replica signal (322, 422, 522) which replicates the near-field noise signal; and communicating (608) the replica signal and the first signal to a far-field noise cancellation process (150). Prior to communicating the replica signal to the far-field noise cancellation process, at least one characteristic of the replica signal is controlled (606) so that the far-field noise cancellation process will identify the near-field noise signal as far-field noise. The far-field noise cancellation process cancels (610) the near-field noise signal and generates (612) an output signal (360, 460, 560) in which the near-field noise signal is reduced in amplitude.

21 Claims, 12 Drawing Sheets

(56) References Cited

U.S. PATENT DOCUMENTS

| | | | | |
|---|---|---|---|---|
| 2009/0060222 | A1* | 3/2009 | Jeong | H04R 1/406 381/92 |
| 2009/0097666 | A1* | 4/2009 | Kim | H04S 1/002 381/59 |
| 2009/0192799 | A1* | 7/2009 | Griffin | 704/270 |
| 2010/0103776 | A1* | 4/2010 | Chan | 367/119 |
| 2010/0232616 | A1 | 9/2010 | Chamberlain et al. | |
| 2011/0129098 | A1* | 6/2011 | Delano | G10K 11/1784 381/71.11 |

OTHER PUBLICATIONS

International Preliminary Report on the Patentability mailed Dec. 4, 2014 Application Serial No. PCT/US2013/041551 in the name of Harris Corporation.

* cited by examiner

NEAR-FIELD NOISE CANCELLATION

STATEMENT OF THE TECHNICAL FIELD

The invention concerns noise cancellation in electronic audio systems. More particularly, the invention concerns near-field noise cancellation systems and methods for cancelling near-field noise.

DESCRIPTION OF THE RELATED ART

Self-Contained Breathing Apparatus ("SCBA") systems typically include a sealed face mask to protect a user's face from the environment. The face mask is usually air-tight and/or water-tight, and will often cover the user's mouth. To allow voice communication, an SCBA face mask can include a voice port that is designed to allow the user's voice to escape from the mask. Thus, for example, a firefighter wearing an SCBA mask with a voice port can utilize a hand-held radio.

In some SCBA systems, an alert is employed within the mask to alert the user to a system condition, such as a low air supply alarm. Such in-mask alerts are desirable because they are easily perceived by SCBA users even in chaotic and noisy environments. In-mask alerts can be acoustic, mechanical, tactile, and/or vibrational in nature. For example, an in-mask alert can be implemented by forcing pulses of air onto the surface of the mask. Frequently, such alerts have an audible component in conjunction with a tactile or vibrational component.

While in-mask alerts convey important information to the SCBA user, they are generally considered a source of unwanted noise in electronic voice communication systems because they generate acoustic signals that are mixed with the user's voice. In-mask alerts can generate acoustic signals through a wide variety of physical mechanisms. For example, systems that force pulses of air onto the surface of a mask will generate acoustic signals in the mask in addition to tactile sensations.

SUMMARY OF THE INVENTION

Embodiments of the present invention concern methods for reducing the amplitude of near-field noise signals that originate in a near field of an acoustic sensing device. The methods generally involve: receiving, from a first acoustic sensing device, a first electronic signal comprising a near-field noise signal; synthesizing a replica signal which replicates the near-field noise signal; and communicating the replica signal and the first electronic signal to a far-field noise cancellation process. Prior to the communicating step, the methods involve controlling at least one characteristic of the replica signal to cause the far-field noise cancellation process to identify the near-field noise signal as far-field noise; and generating an output signal of the far-field noise cancellation process in which the near-field noise signal is reduced in amplitude.

Embodiments of the present invention also concern near-field noise cancellation systems implementing the above described method embodiments. The system embodiments comprise a first acoustic sensing device configured to receive acoustic signals and generate a first electronic signal based on the acoustic signals; a far field noise cancellation device comprising a primary input and a secondary input, and configured to cancel received signals identified as far-field noise; and at least one electronic circuit configured to: (1) receive, from the acoustic sensing device, the first electronic signal comprising a near-field noise signal; (2) synthesize a replica signal which substantially replicates the near-field noise signal; (3) control at least one characteristic of the replica signal so that the far-field noise cancellation device will identify the near-field noise signal as far-field noise; and (4) communicate the first electronic signal to the primary input and the replica signal to the secondary input of the far-field noise cancellation device.

BRIEF DESCRIPTION OF THE DRAWINGS

Exemplary embodiments will be described with reference to the following drawing figures, in which like numerals represent like items throughout the figures, and in which.

DETAILED DESCRIPTION

Figure 1:
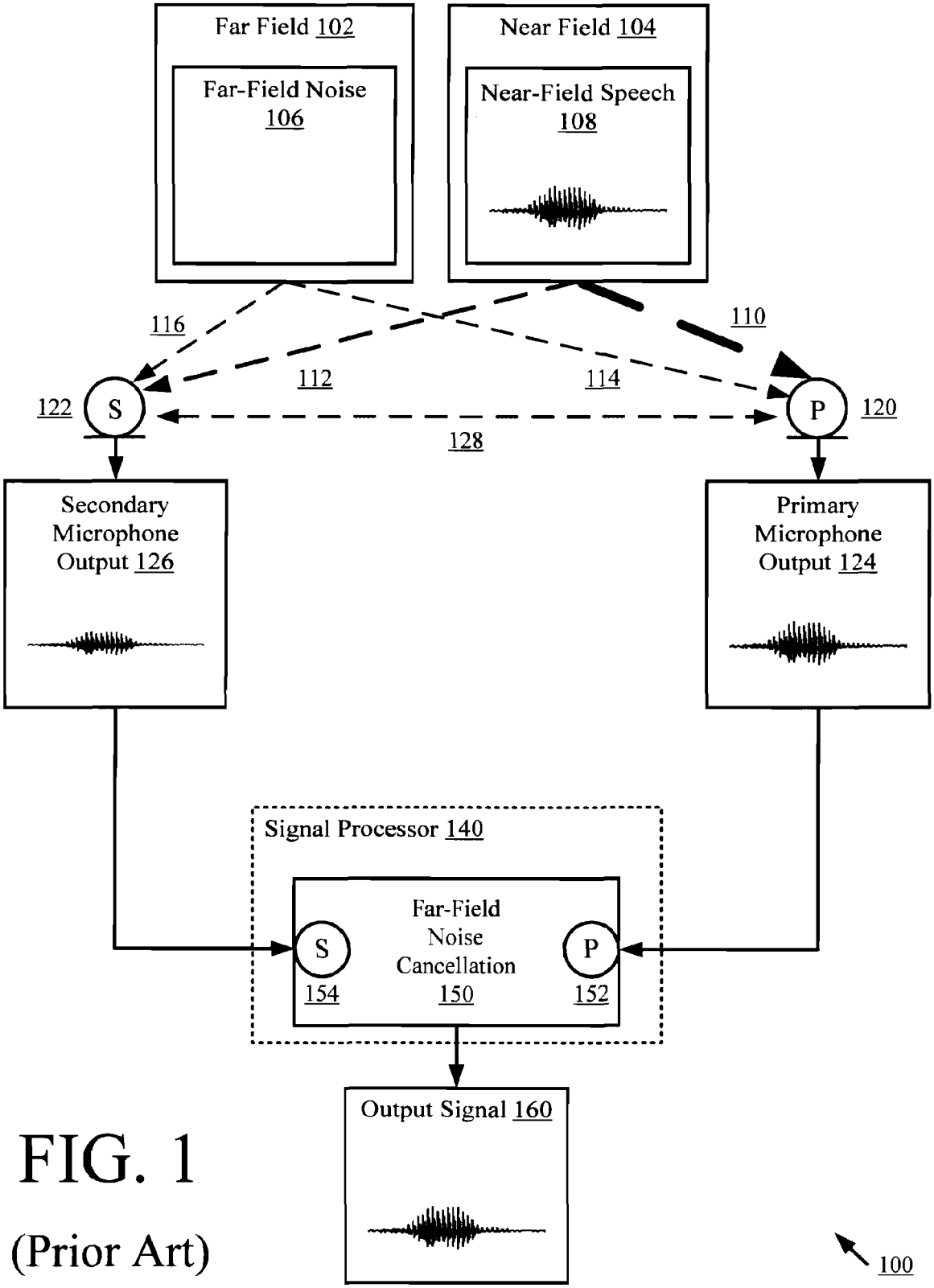
FIG. 1 (Prior Art)
FIG. 1 is a schematic illustration of an exemplary prior art system that is useful for understanding the present invention.

The present invention is described with reference to the attached figures. The figures are not drawn to scale and they are provided merely to illustrate exemplary embodiments of the present invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

The present invention concerns utilizing conventional far-field noise cancellation techniques to cancel near-field noise signals that originate in a near field of an acoustic sensing device. Exemplary embodiments of the present invention relate to synthesizing a replica signal that replicates a near-field noise signal. The near-field noise signal is communicated to a primary input, and the replica signal is communicated to a secondary input, of a conventional far-field noise cancellation process. The replica signal is synthesized and/or controlled to cause the conventional two-input noise cancellation process to identify the near-field noise signal as far-field noise. Thus, exemplary embodiments of the present invention allow conventional far-field noise cancellation techniques to be utilized to cancel near-field noise signals.

The word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is if, X employs A; X employs B; or X employs both A and B, then "X employs A or B" is satisfied under any of the foregoing instances.

As used herein, the term "signal" means any type of information conveyed through any medium. A signal can be acoustic (i.e., propagated by a physical medium) or electronic (i.e., electromagnetic) in nature. Electronic signals can be represented in digital or analog form. A transducer can be used to generate an electronic signal representative of an acoustic signal, such as in an acoustic sensing device. A transducer can also be used to generate an acoustic signal based on an electronic signal, such as in a speaker.

As used herein, the term "amplitude" means any measurement of signal magnitude. Amplitude can be measured in decibels ("dB"). Various methods for calculating amplitude are known in the art, including, but not limited to, peak amplitude, peak-to-peak amplitude and root mean square amplitude. Amplitude can be calculated based on current, voltage, power, or any other property as is known in the art.

As used herein, the term "noise" is used to refer to any unwanted or undesirable signal in a communications system. For example, in a voice communications system, any signal other than user speech or voice will often be regarded as noise.

As used herein, the terms "cancel" and "cancellation" are used to refer to any process that substantially reduces the amplitude of a signal.

As used herein, the term "far field" refers to locations which are sufficiently distant from a sound source such that the sound level drops at a rate of about 6 dB each time the distance doubles. The exact location where the far field begins will depend upon the size of the source aperture used to produce the acoustic signal. The location where the far field begins will be greater (relative to the location of the source) as the aperture size increase. For example, the far field will begin at a larger distance from a loudspeaker that has a 20 inch aperture as compared to a loudspeaker that has a 2 inch aperture. Locations that are in the far field relative to a sound source are generally a distance from the sound source which is at least about two meters. Stated differently, a sound source in the far field of a microphone is one that is at least about two meters or more from a microphone used to sense the sound produced by that source.

As used herein, the term "near field" refers to a region which is relative close to a sound source. More particularly, the term refers to locations that are sufficiently near to a sound source such that drastic fluctuations in sound levels will be noticeable with small changes in distance. In the near field, a change in distance of just a few inches relative to the location of the source can cause the sound level to vary by as much as 10 dB. The near field of a sound source is often defined as a distance which is ¼ of the longest wavelength of a source. As an example, typical human voiced speech has a fundamental frequency of between about 85 to 255 Hz, which corresponds to a wavelength of about 3.9 to 1.3 meters. If the near field is ¼ of this wavelength, then the near field would include locations that are 1.3 to 0.33 meters from the source. Accordingly, for purposes of the present specification, the near field relative to a sound source can generally be understood as a distance from the sound source which is less than about 2 meters. Stated differently, a sound source in the near field of a microphone is one that is less than about two meters from a microphone used to sense sound produced by that source. The precise threshold between "near-field" and "far-field" may depend on many factors, including properties of the signal source, the acoustic sensing device, the medium of propagation, and/or the signal itself, as is known in the art. The threshold can be a complex function and can be adjusted by a practitioner as is known in the art.

In this specification, when a microphone is described as being used to sense an acoustic signal which has originated from a source that is located in the far field, then the audio signal is referred to as a far field signal. For example, where a noise source is located in the far field relative to a microphone element, then the noise signal detected by that microphone is referred to herein as "far field noise." Conversely, when a person speaking into a microphone is located in the near field relative to a microphone element, then the acoustic voice signal detected by that microphone element can be referred to as a near field audio signal or a near field voice signal. For consistency and convenience, the terms "near-field" and "far-field" are also used herein to describe electronic signals generated by a sound sensor (microphone) that is located in the near field or far field of a sound source.

As used herein, the term "replica signal" is used to refer to a signal that is substantially similar to a reference signal with respect to at least one characteristic. For example, a replica signal may have one or more signal components that are substantially similar in frequency, phase, and/or amplitude as compared to the reference signal. The replica signal can be a reproduction of the reference signal over some time period of limited duration. For example, in the case of a reference signal having periodic or quasi-periodic properties, the replica signal can be a reproduction of the reference signal over some portion of a period associated with that signal. The portion can be an entire period or some time period less than an entire period. The replica signal can be substantially an exact reproduction of a reference signal such that the sampling used to generate the replica signal would satisfy the well known Nyquist sampling criterion. Alternatively, the replica signal can be a band limited version of the reference signal, meaning that the replica signal is essentially an exact reproduction of the reference signal, but only within certain frequency limits that are of interest.

As used herein, the term "quasi-periodic" is used to describe any signal that comprises at least one repeating component. The repeating component may repeat with a predictable timing interval, such that a period, quasi-period or approximate period can be determined for the signal. For example, an in-mask vibrational alert used in SCBA systems typically pulses air onto a user's mask at substantially regular intervals, such that the timing of future pulses can be predicted based on perceived timing of previous pulses. The term "quasi-periodic" is meant to include signals that repeat with a precise periodicity (e.g., "periodic" signals) as well as signals that repeat with an imprecise periodicity. As is known in the art, a signal may repeat with an irregular timing interval, and yet an approximate period or quasi-period can be computed for the signal using known signal analysis techniques.

In many communication systems, noise cancellation techniques are employed to reduce or eliminate unwanted acoustic signals from audio signals received at one or more acoustic sensing devices. In such systems, any audio signal other than the user's voice is generally considered noise. Some examples of noise in a voice communication system include in-mask alerts, machines, motors, music, and voices of non-users. Some conventional noise cancellation techniques use hardware and/or software for analyzing received audio signals to detect noise therein. When noise is detected, conventional noise cancellation techniques are used to attempt to cancel the detected noise and provide an output audio signal having a reduced noise amplitude level therein.

Some conventional noise cancellation techniques are designed to cancel far-field signals while preserving near-field signals. Such techniques are generally referred to as "far-field noise cancellation." Applications for far-field noise cancellation include removal of background noise that originates in the far field while preserving user speech that originates in the near field. Various techniques are known in the art for discriminating between near-field and far-field signals. The amplitude of sound in the near field of a sound source will vary much more rapidly over small distances (e.g. 1-6 inches) as compared to sounds originating in the far field. Accordingly, some far-field noise cancellation systems use this fact to discriminate between sounds at a location which is in the near field relative to a source versus sounds that are in the far field relative to a source. These systems generally make use of two microphones which are spaced a small distance (1-6 inches) apart. A sound signal can be detected by each microphone and relative amplitude of the two signals can be evaluated to determine whether the sound originated in the far field versus the near field. For example, when the detected output signals from the two microphones indicate that the sound amplitude changed significantly over the relatively small distance between such microphones, then it can be inferred that the sound originated in the near field.

Referring now to FIG. 1, there is provided a schematic illustration of an exemplary prior art system 100 that includes a processor for reducing far-field noise. System 100 employs two microphones, including primary microphone 120 and secondary microphone 122, each of which can be any acoustic sensing device now known or later developed.

Near-field speech 108 is an acoustic signal which is sensed at a location which is in the near field 104 relative to the source of the near-field speech. The near field speech is sensed or detected by a primary microphone 120 and secondary microphone 122. Near-field speech 108 travels to primary microphone 120 along path 110, and to secondary microphone 122 along path 112.

Far-field noise 106 is an acoustic signal which is sensed by microphones 120, 122 at a location which is in the far field 102 with respect to a source of such noise signal. Far-field noise 106 travels to primary microphone 120 along path 114, and to secondary microphone 122 along path 116.

The two microphones 120 and 122 are separated in space by a relatively small distance 128, which is usually about 1 to 6 inches. Path 110 is shorter than path 112, such that near-field speech 108 will be received with substantially greater amplitude at primary microphone 120 as compared to secondary microphone 122. Path 114 and path 116 can be different in length, but the far field noise is received at approximately equal amplitude at microphones 120, 122. This is due to the fact that amplitude levels vary far less over small distances (e.g., 1 to 6 inches) when measured at locations in the far field, as compared to locations in the near field.

Figure 8:
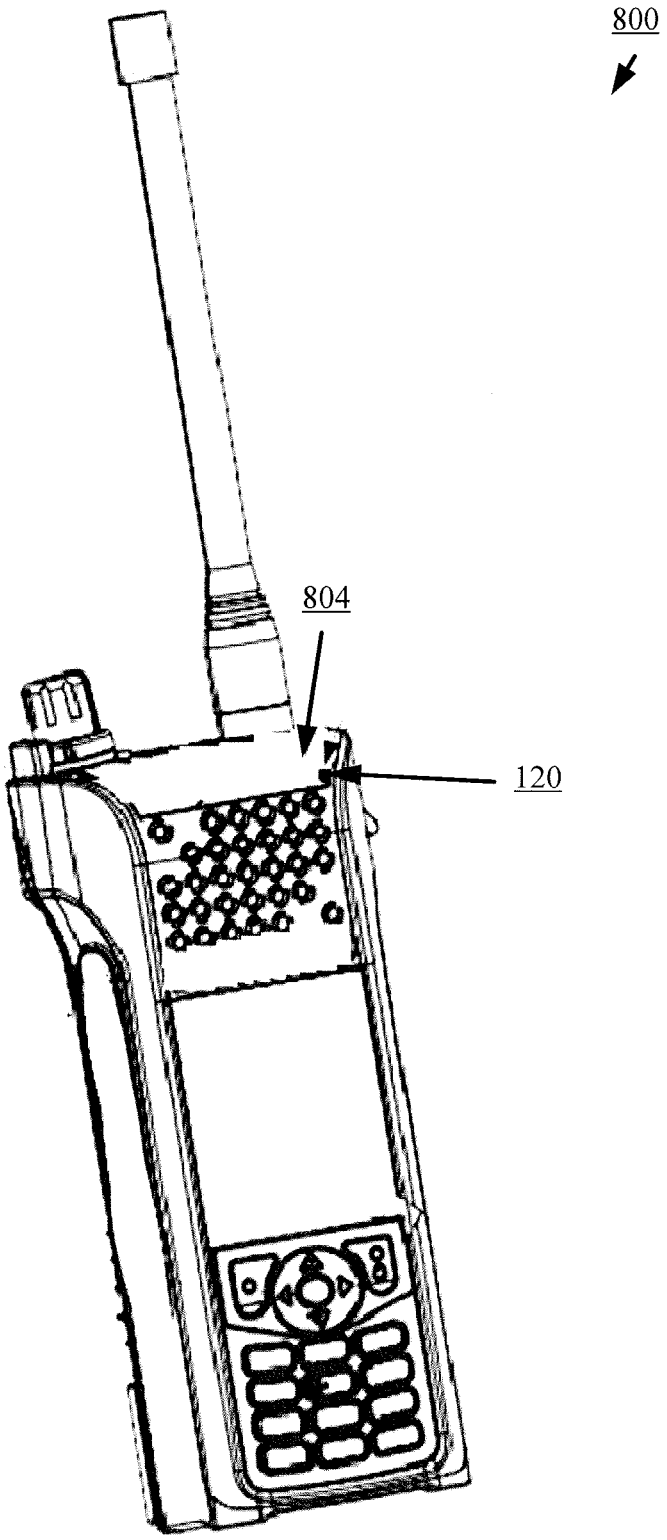
FIG. 8 is a front perspective view of an exemplary communication device implementing the method of FIG. 6 that is useful for understanding the present invention.
Figure 9:
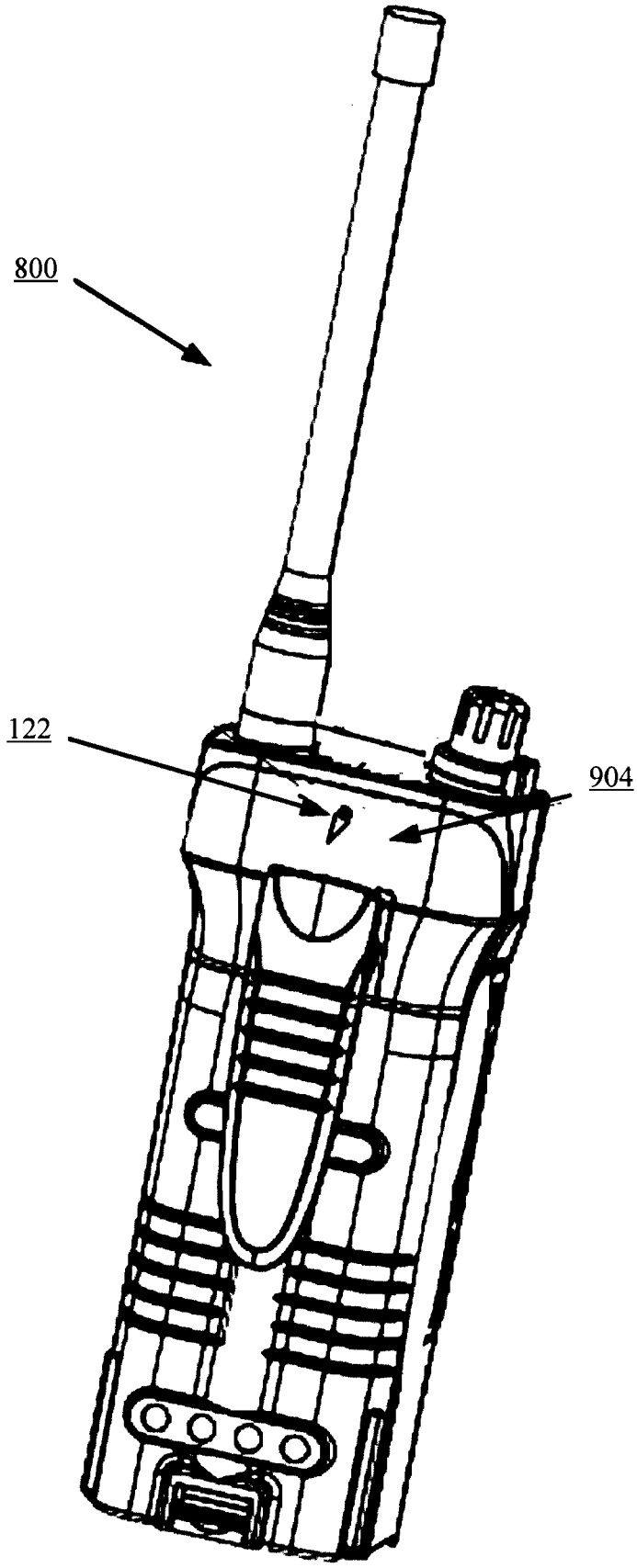
FIG. 9 is a back perspective view of the exemplary communication device shown in FIG. 8.

In a typical scenario, primary microphone 120 will be located on a front face of a communications device, such as device 800 shown in FIGS. 8-9. The secondary microphone 122 will usually be located on a back side of the communications device 800. As noted above, the amplitude difference for sounds received by the two microphones 120, 122 will be substantially greater for sounds sensed at a location in the near-field relative to the source (e.g., near-field speech 108) as compared to sound sensed at a location that is in the far-field relative to its source (e.g., far-field noise 106).

Primary microphone 120 generates primary microphone output 124 in real-time based on received acoustic signals. Primary microphone output 124 is an electronic signal that is representative of the acoustic signals received, including far-field noise 106 and near-field speech 108. Similarly, secondary microphone 122 generates secondary microphone output 126. For reasons explained above, near-field speech 108 will have a higher amplitude in primary microphone output 124 as compared to secondary microphone output 126. Far-field noise signal 106 will appear in both output signals with substantially similar amplitude. Primary microphone output 124 and secondary microphone output 126 are communicated respectively to primary input 152 and secondary input 154 of conventional far-field noise cancellation process 150.

Signal processor 140 comprises conventional far-field noise cancellation process 150 which is effective to cancel far-field signals while preserving near-field signals. Far-field noise cancellation process 150 can be implemented as hardware, software, or any combination thereof. For example, far-field noise cancellation process 150 can comprise an algorithm executed by signal processor 140 or implemented by a separate hardware circuit. Far-field noise cancellation process 150 receives signals at inputs 152 and 154, and generates an output signal 160 comprising received near-field signals with the far-field signals substantially reduced in amplitude. For purposes of cancelling far-field noise, the near-field speech signal 108 can be identified by a relatively large amplitude differential between primary and secondary inputs 152 and 154, and far-field noise signal 106 can be identified by a relatively small amplitude difference between the two inputs. For example, far-field noise cancellation process 150 can be configured to identify as near-field any signal having an amplitude differential between inputs greater than a pre-defined amplitude threshold. Conversely, any signal having an amplitude differential between inputs that is less than or equal to the pre-defined amplitude threshold can be identified as far-field.

It should be understood that the foregoing description of a far field noise cancellation process is provided as merely one possible example. Other far field noise cancellation processes can operate using techniques that are similar or different. However, all such systems will use certain characteristics of received audio to distinguish near field audio signals from far field audio signals.

Figure 2:
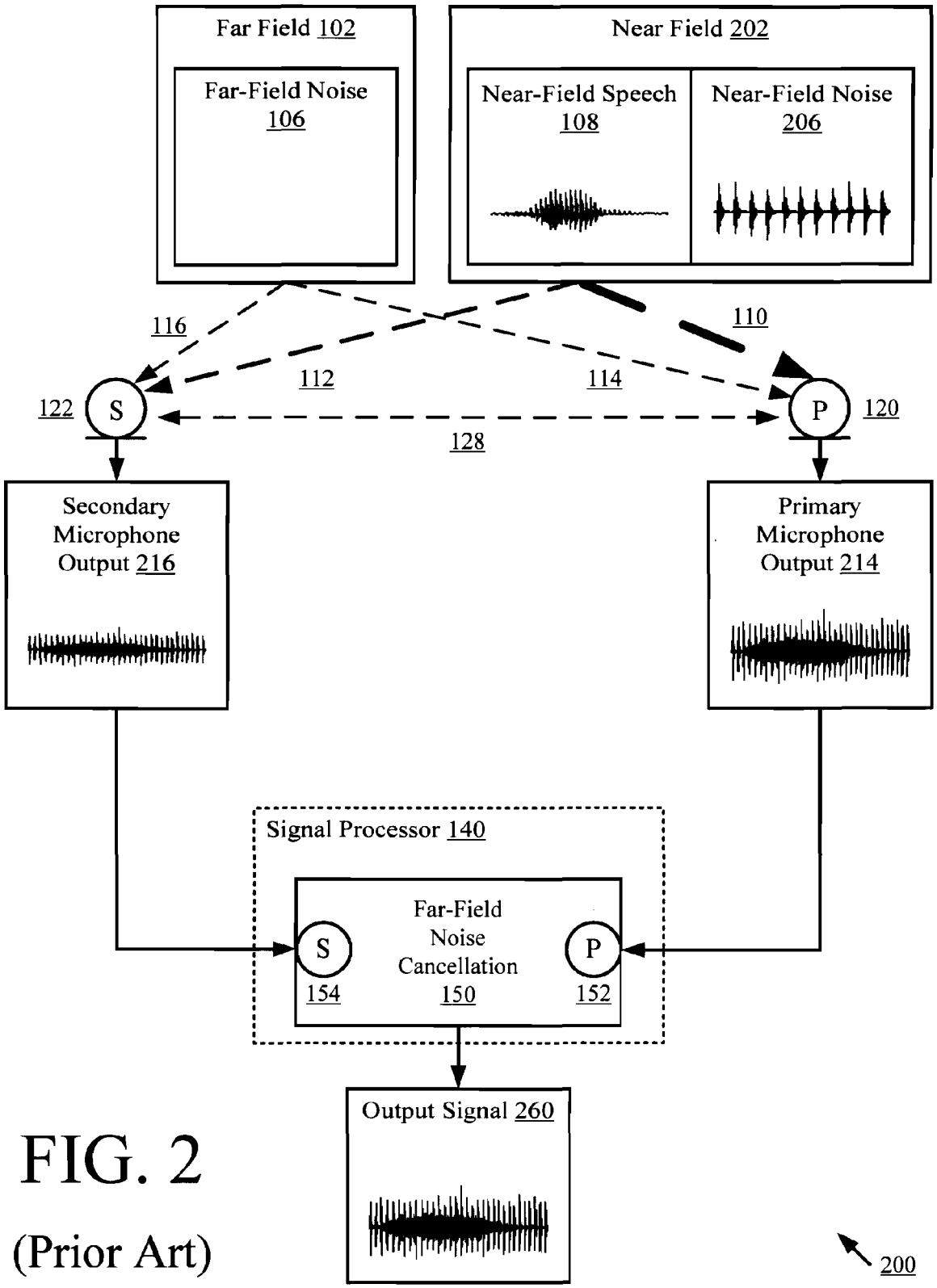
FIG. 2 (Prior Art)
FIG. 2 is a schematic illustration of an exemplary prior art system that is useful for understanding the present invention.

Referring now to FIG. 2, there is provided a conceptual block diagram of an exemplary prior art system 200 that is useful for understanding the present invention. System 200 is similar to system 100, except that near-field noise 206 has been added. Near-field noise 206 originates from a source that is close to microphones 120, 122 such that the microphones can be said to be in the near field relative to the source. For example, near-field noise 206 can be a sound produced by an in-mask alert. In such a scenario, near field speech 108 and near-field noise 206 may escape from the mask via a voice port. Thus, microphones 120, 122 are located in the near field with respect to the sources of the near-field speech 108 and near-field noise 206. Near-field noise 206 will generally follow the same paths as near-field speech 108, i.e., paths 110 and 112. Therefore, near-field noise 206 will be received with substantially greater amplitude at primary microphone 120 than at secondary microphone 122. The far-field noise cancellation process 150 will automatically recognize that the near-field noise 206 is being sensed within the near field of the microphones. Accordingly, the far field noise cancellation process will not remove the near field noise 206 when that signal is processed by the far field noise cancellation process. Thus, near-field noise signal 206 will not be cancelled, and output signal 260 will include near-field noise signal 206 in addition to near-field speech signal 108.

In an electronic communication system near-field noise 206 will interfere with communication of near-field speech 108. Notably, components of near-field noise signal 206 may fall within the pitch range of the human voice, and near-field noise signal 206 may have a large amplitude relative to near-field speech signal 108, making it difficult to understand speech in near-field speech signal 108 when near-field noise signal 206 is present. Also, communication systems are often configured to communicate a voice based output signal 260 to a voice encoder ("vocoder"). The vocoder is provided for converting a speech signal to a digital electronic signal prior to transmission via a wireless communication system. In such a scenario, if the near-field noise signal 206 is a quasi periodic acoustic alert that is generated by puffs of air used to vibrate a face mask, then such alert signal may render the encoded speech unintelligible. More particularly, in such a scenario, components of near-field noise signal 206 having a pitch within the pitch range for the human voice may be misidentified as voice signals by a pitch detection algorithm. This can result in a catastrophic failure of the voice coding process that actually leaves gaps in the digital speech signal output from the vocoder.

Figure 3:
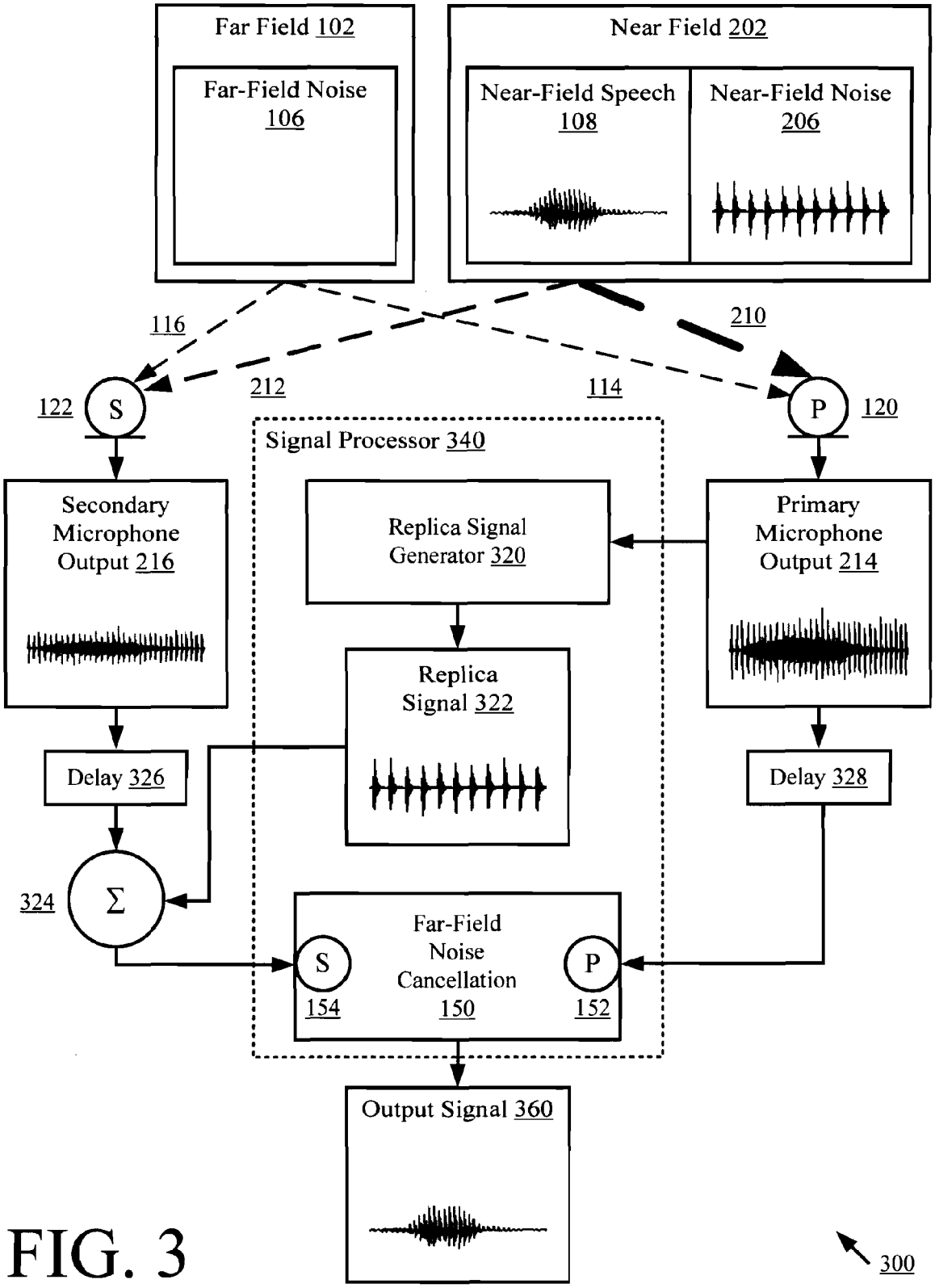
FIG. 3 is a schematic illustration of an exemplary system that is useful for understanding the present invention.

Referring now to FIG. 3, there is provided a schematic illustration of an exemplary system 300 that is useful for understanding the present invention. Signal processor 340 is configured to cancel near-field noise signals using conventional far-field noise cancellation process 150. Signal processor 340 comprises replica signal generator 320, which analyzes primary microphone output 214 (or secondary microphone 216) to identify near-field noise 206 based on a known signature or characteristic associated with such near field noise. When the presence of near-field noise 206 is detected, the replica signal generator synthesizes replica signal 322, which is essentially a replica of the near field noise 206. Replica signal 322 is then communicated to summation process 324 where it is combined with secondary microphone output 216. The combined signal is then communicated to input 154 of the far-field noise cancellation process 150. Delay elements 326 and 328 are optionally provided to controllably delay the outputs of secondary microphone 122 and primary microphone 120. Summation process 324 can be performed by signal processor 340 or by dedicated hardware, as mere non-limiting examples.

Figure 11:
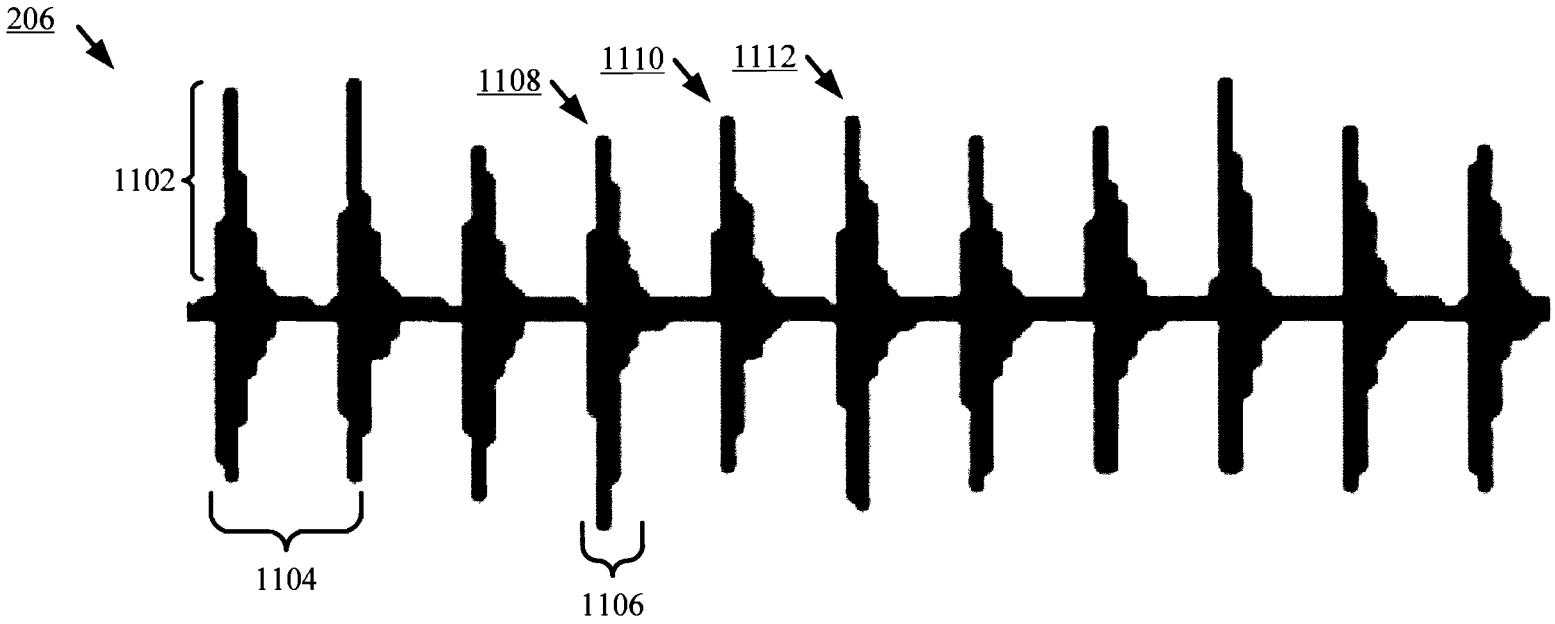
FIG. 11 depicts an exemplary near-field noise signal that is useful for understanding the present invention.

The inventors herein have recognized that in-mask alerts in SCBA systems typically exhibit predictable characteristics. For example, in-mask alerts often produce a recognizable acoustic pattern or signature. Thus, an acoustic signal produced by an in-mask alert may be recognized using pattern recognition techniques as described in detail herein. For example, predictable characteristics of in-mask alerts may include, without limitation, timing, periodicity, frequency, phase, and shape. In the case of an in-mask alert implemented by channeling pulses of air onto the mask surface, the pulses of air may reach the mask with a predictable timing, and each pulse may generate a substantially similar acoustic signal. An exemplary near-field noise signal 206 produced by a forced-air type in-mask alert is illustrated in FIG. 11. Signal 206 is comprised of a series of pulses, including pulses 1108, 1110, and 1112, with each pulse corresponding to one pulse of air. Each pulse has a peak amplitude 1102, and a pulse duration 1106. Signal 206 can be characterized as quasi-periodic, with a pulse period 1104 equal to the timing between pulses. Pulse period 1104 can be an approximate or average value based on the timing between multiple pulses.

Various techniques can be used to identify near-field noise signal 206 even when it is mixed with another signal, such as in primary microphone output 214. For example, replica signal generator 320 may employ peak detection to identify one or more pulses within near-field noise signal 206. Signal processor 340 may also be configured to detect the periodicity of near-field noise signal 206. For example, the in-mask alert may deliver 10 pulses of air per second, such that a pulse strikes the mask approximately every 1/10 of one second, and pulse period 1104 equals 100 milliseconds (ms). Furthermore, the shape of an acoustic signal produced by each pulse of air may conform to a recognizable shape or signature. The system may be configured to store one or more models of acoustic signals generated by in-mask alerts, as described in detail below.

Replica signal 322 is controlled so as to cause the far-field noise cancellation process 150 to identify near-field noise 206 as far-field noise. For example, replica signal 322 may be controlled so that it has substantially the same amplitude as near-field noise 206 in primary microphone output 214. Any suitable arrangement can be used to control the amplitude of replica signal 322. For example, in some embodiments frequency coefficients can be adjusted as part of the signal generation process. Alternatively, a variable amplifier and/or attenuator circuit (not shown) can be used to vary the amplitude of the replica signal. Thus, when replica signal 322 is present at input 154, the amplitude differential between the replica signal 322 and near field noise 206 will be relatively small. In such a scenario, the far-field noise cancellation process 150 will interpret the near-field noise 206 as noise originating in the far field, and therefore will reduce or cancel the near-field noise signal 206.

Signal processor 540 may be configured to delay the primary microphone input to far field noise cancellation process 150, and any secondary microphone input 216 provided to summation process 324. This delay can be used in order to provide time for analyzing and generating the replica signal. The delay can also be used to properly synchronize the signals. As will be understood based on the discussion of FIG. 1, the far-field noise cancellation process 150 in FIG. 3 will also have the ability to cancel far-field noise 106.

Figure 4:
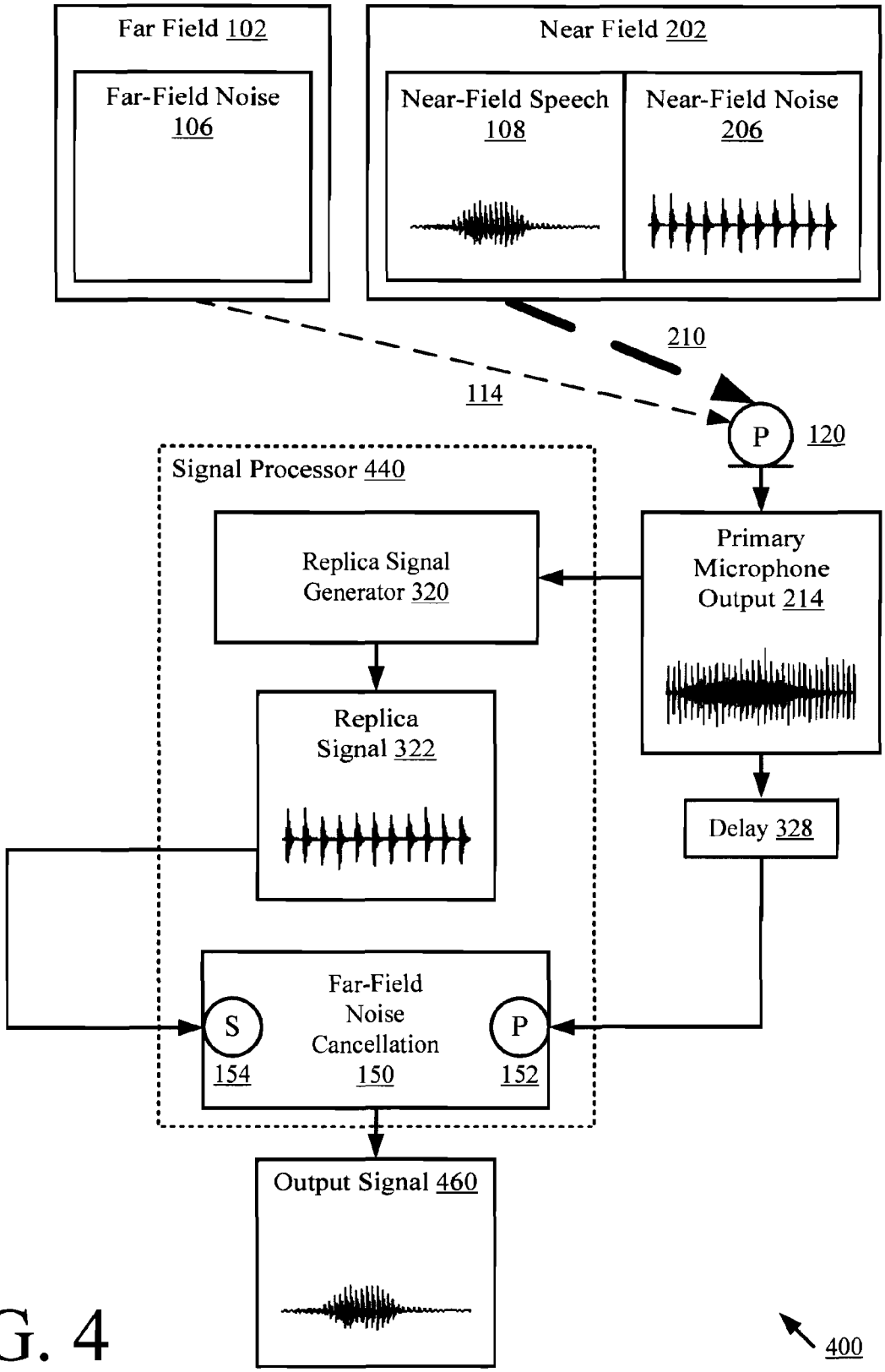
FIG. 4 is a schematic illustration of an exemplary system that is useful for understanding the present invention.

Referring now to FIG. 4, there is provided a conceptual block diagram of an alternative embodiment of the present invention. System 400 is similar to system 300, with some important differences. Notably, system 400 does not include secondary microphone 122 and summation process 324. As will be understood from the foregoing discussion, the presence of secondary microphone 122 and secondary microphone output 216 is not needed to achieve cancellation of near-field noise signal 206. As in FIG. 3, replica signal 322 is synthesized by replica signal generator 320 and communicated to input 154 of far-field noise cancellation process 150. When replica signal 322 is applied to input 154 it causes near-field noise signal 206 to be identified as far-field noise by far-field noise cancellation device 150. This technique is similar to the process as described above with reference to FIG. 3, but eliminates the need for a second microphone 122 and secondary microphone output 216. The absence of these elements does not affect the identification or cancellation of near-field noise signal 206.

System 400 will be unable to cancel far-field noise signal 106 due to the absence of secondary microphone 122 and secondary microphone output 216, but this limitation may not be important in applications where far-field noise is limited or otherwise low in amplitude.

Figure 5:
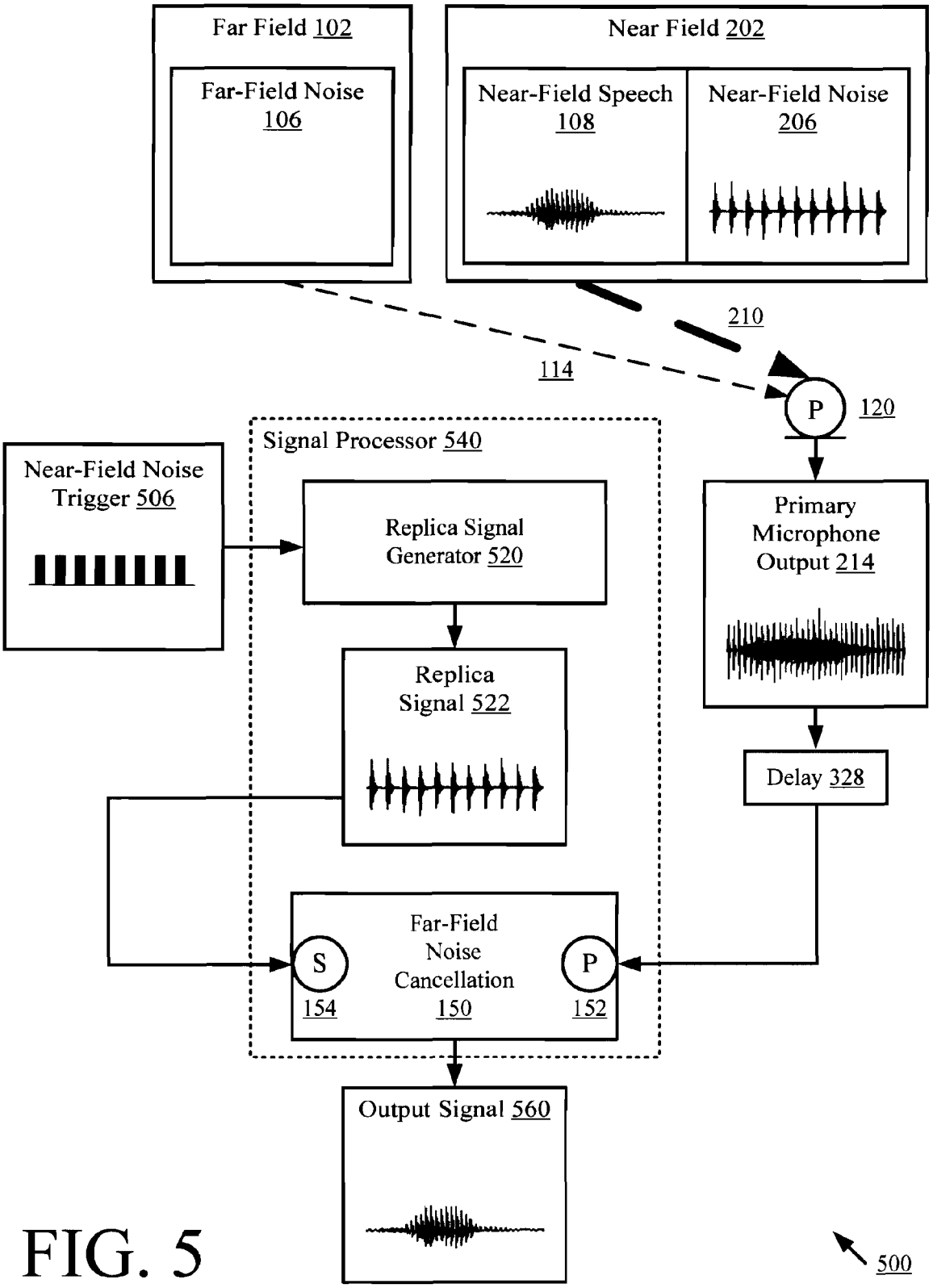
FIG. 5 is a schematic illustration of an exemplary system that is useful for understanding the present invention.

Referring now to FIG. 5, there is provided a conceptual block diagram of a third embodiment of the invention. System 500 is similar to system 400, with some important differences. For example, in system 500, primary microphone output 214 is not communicated to the replica signal generator 520 for purposes of triggering the generation of the replica signal. Instead, an electronic near-field noise trigger signal 506 is communicated to the replica signal generator for this purpose. Near-field noise trigger signal 506 is obtained from an electronic signal that is used to control an in-mask alert which is known to produce near-field noise 206. For example, the electronic near-field noise trigger signal 506 can be a signal that is used to control an air valve that meters puffs of air into a face mask on a quasi-periodic basis. In such an embodiment, the electronic near field noise signal 506 will have a period and timing that corresponds to a period and timing of the near field noise 206.

Replica signal generator 520 receives and analyzes near-field noise trigger signal 506 and synthesizes replica signal 522. As in systems 300 and 400, the replica signal generator 520 synthesizes replica signal 522. When the replica signal 522 is applied to the far-field noise cancellation process 150 concurrently with the near-field noise contained in the primary microphone output 214, the near-field noise signal 206 will be identified as far-field noise, and will be removed. As shown in FIG. 5, the system 500 can also include a delay element 328 for purposes of time synchronizing the electronic signal representation of near-field noise 206 with the replica signal 522.

Figure 6:
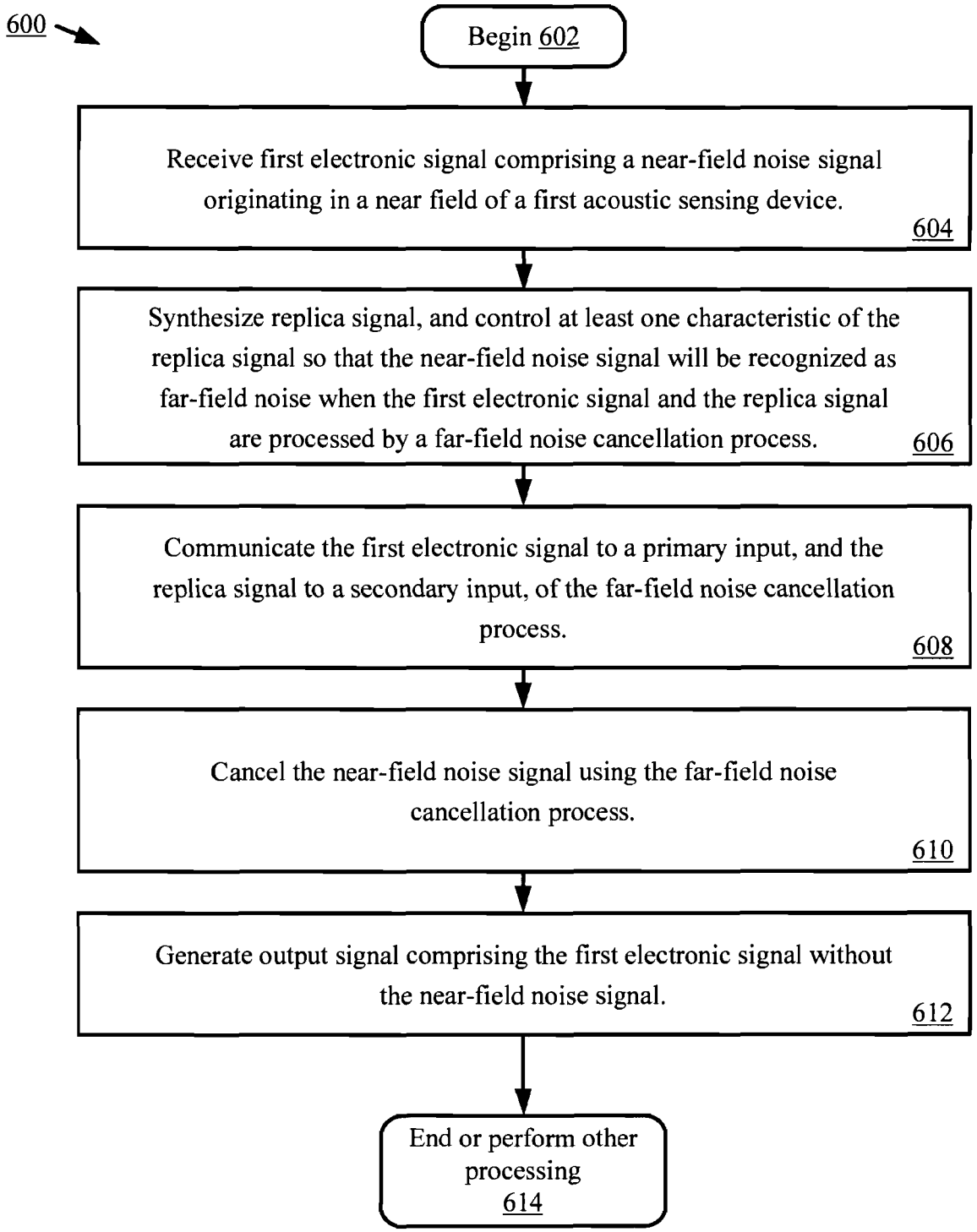
FIG. 6 is a process flow diagram providing a high-level overview of an exemplary method that is useful for understanding the present invention.

Referring now to FIG. 6, there is provided a process flow diagram providing a high-level overview of an exemplary method 600 that is useful for understanding the present invention. Method 600 is implemented in a noise-cancelling system. For example, method 600 can be implemented by a signal processor such as signal processor 340, 440, or 540. Method 600 begins with step 602.

At step 604, the system receives a first electronic signal comprising a near-field noise signal originating in a near field of a first acoustic sensing device. For example, the first electronic signal can be primary microphone output 214, and the near-field noise signal can be near-field noise signal 206, as shown in FIGS. 3-5.

At step 606, the system synthesizes a replica signal, and controls at least one characteristic of the replica signal so that the near-field noise signal will be recognized as far-field noise when the first electronic signal and the replica signal are processed by a far-field noise cancellation device. For example, the replica signal can be replica signal 322 or 522, as shown in FIGS. 3-5. The far-field noise cancellation process can be far-field noise cancellation process 150 as described with reference to FIGS. 1-5.

At step 608, the system communicates the first electronic signal to a primary input, and the replica signal to a secondary input, of the far-field noise cancellation process. For example, the primary input can be primary input 152 and the secondary input can be secondary input 154, as shown in FIGS. 1-5. The replica signal can optionally be combined with secondary microphone output 216 prior to communication to the far-field noise cancellation process, for example, in summation element 324 shown in FIG. 3.

At step 610, the system cancels the near-field noise signal using the far-field noise cancellation process. As described above with reference to FIGS. 3-5, the replica signal causes the far-field noise cancellation process to identify the near-field noise as far-field noise. The far-field noise cancellation process then cancels the near-field noise using conventional noise cancellation techniques.

At step 612, the system generates an output signal comprising the first electronic signal with the near-field noise signal eliminated or at least reduced in amplitude. For example, the output signal can be output signal 360, 460, or 560, as shown in FIGS. 3-5. The near-field noise signal has been reduced or cancelled at step 610, such that the output signal has a reduced amount of the near-field noise. For example, if the first electronic signal comprises near-field speech signal 108 mixed with near-field noise signal 206, the output signal will include near-field speech signal 108 with a substantially higher speech-to-noise ratio.

Step 614 is the end of the exemplary method 600, and the system proceeds to other tasks, such as repeating method 600 in a loop. The output signal can be communicated to another system, such as a wireless voice communications system as described above.

Figure 7A:
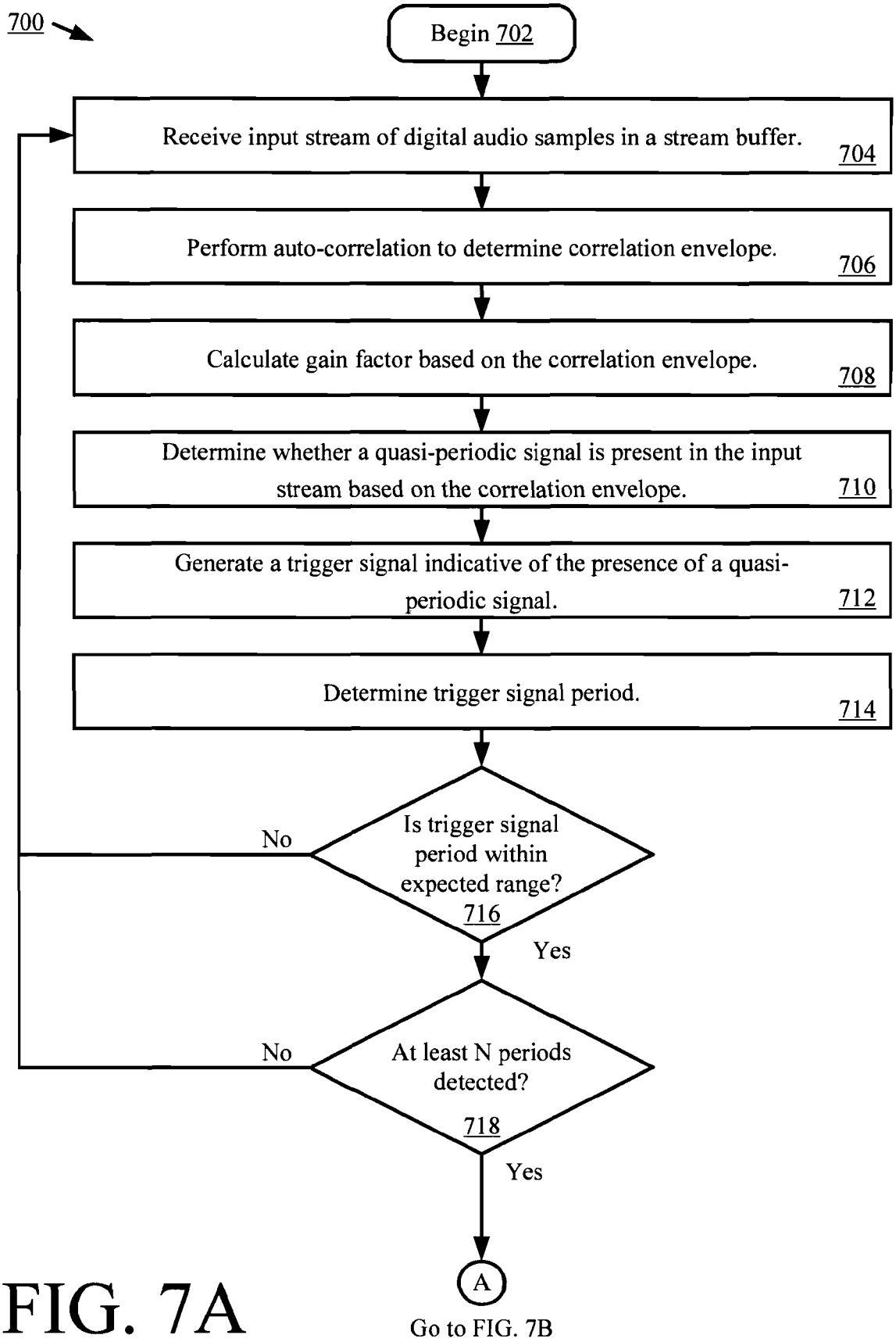
FIGS. 7A-7B collectively provide a detailed process flow diagram of an exemplary method that is useful for understanding the present invention.
Figure 7B:
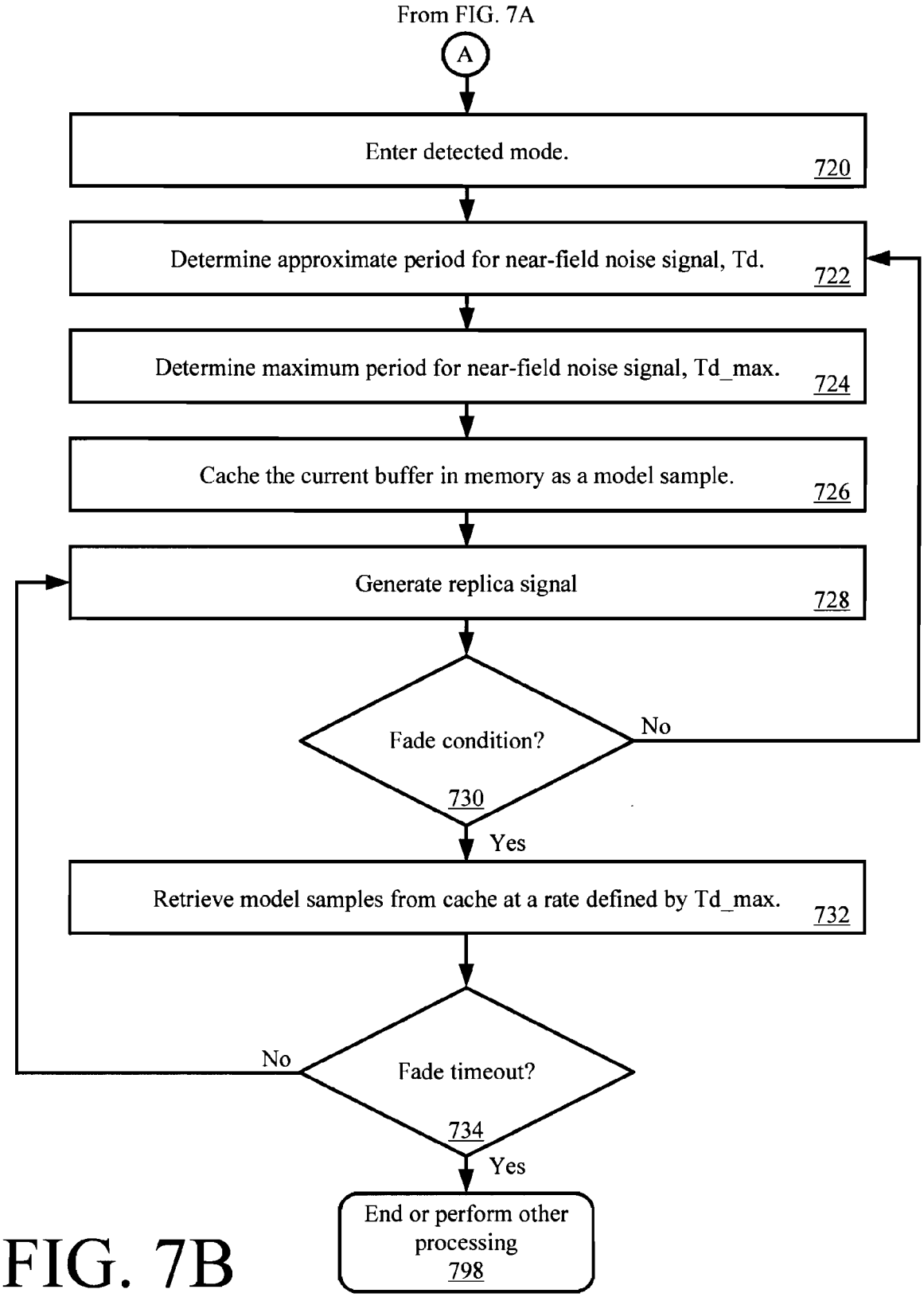

Referring now to FIGS. 7A-7B, there is provided a detailed process flow diagram of an exemplary method 700 that is useful for understanding the present invention. Method 700 can be implemented, for example, by replica signal generator 320 or 520 in any of the exemplary systems 300, 400, and 500 shown in FIGS. 3-5 and described above. Method 700 can be understood as a detailed exemplary embodiment for step 606 of FIG. 6. It should be noted that method 700 can be executed by a processor in an iterative loop, and may be executed as one or more parallel threads and/or processes. Method 700 begins with step 702.

At step 704, the system receives an input stream of digital audio samples. The input stream can be received, for example, from a digital encoder that encodes the primary output 214 of primary microphone 120. As described above, the stream can include near-field noise signal 206, near-field speech signal 108, and far-field noise signal 106. The samples are stored in a stream buffer in a computer-readable memory, such as memory 1016. The stream buffer is configured to store at least two periods of a quasi-periodic near-field noise signal, based on an expected average period thereof.

At step 706, the system performs auto-correlation to determine a correlation envelope. Auto-correlation techniques are well known in the art, and generally include comparing one portion of a signal to another portion of the same signal. The system compares the two periods to each other to determine a correlation envelope value.

At step 708, the system calculates a gain factor based on the correlation envelope. The gain factor will be applied to the input stream in future iterations of method 700, in order to normalize the expected correlation value. For example, the system can be configured to update the pre-determined threshold used at step 710.

At step 710, the system determines whether a quasi-periodic signal is present in the stream based on the correlation envelope value. For example, the system can be configured to identify a presence of a quasi-periodic signal if the correlation value is above a pre-determined threshold, such as a user-supplied threshold. The identification of a quasi-periodic signal will be used to generate the trigger signal at step 712.

At step 712, the system generates a trigger signal indicative of the presence of a quasi-periodic signal in the input stream based on the result of step 710. For example, the trigger signal can be a binary digital signal that has a value of "1" when a pulse has been detected in the input stream, and a value of "0" otherwise. Thus, the trigger signal will have a period that is substantially similar to the period of the detected quasi-periodic signal.

At step 714, the system determines a period for the trigger signal. For example, the trigger signal period can be determined using edge detection to detect the positive and negative edges of the trigger signal. The trigger signal period can be based on a single period of the quasi-periodic signal.

At step 716, the system determines whether the trigger signal period determined at step 714 is within an expected range for a quasi-periodic near-field noise signal. For example, as discussed above, an in-mask alert can generate pulses of air with a timing between pulses of about 30 milliseconds (ms). Thus, the expected range could be 25-35 ms, as an arbitrary example. If the trigger signal period is within the expected range then the system increments the number of pulses detected, and flow proceeds to step 718. Otherwise, flow proceeds back to step 704.

At step 718, the system determines whether the number of quasi-periodic pulses detected consecutively (e.g., within a pre-determined time window) exceeds a pre-determined threshold "N", where N is an integer value. This step is employed to prevent false-positives (e.g., erroneous detection of in-mask alert noise). If the number of detected pulses exceeds the threshold, then flow proceeds to step 720. Otherwise, flow proceeds back to step 704. Hysteresis can be applied in the detection process so that failure to detect one or more pulses does not reset the count of detected pulses, but instead reduces a variable associated with probability of quasi-periodic noise detection.

It should be noted that the system may be configured to continue executing steps 704-718 in a parallel thread or process. In other words, even when flow proceeds to step 720, the system may be configured to concurrently execute steps 704-718 in parallel to steps 720-734.

At step 720, the system enters "detected mode." In detected mode, the system has previously detected a sufficient number of quasi-periodic pulses to determine that a quasi-periodic near-field noise signal is present in the input audio stream, as described above with reference to step 718. Notably, in detected mode the system will attempt to cancel the quasi-periodic near-field noise signal even when it enters a fade condition, such as when the quasi-periodic noise signal is obscured by a near-field voice signal or by other noise, as described below.

At step 722, the system determines an average period "Td" for the quasi-periodic near-field noise signal based on historical data. Average period "Td" can be based on a predetermined number of historical pulses. "Td" is a variable that can be stored in memory and updated with each iteration of method 700.

At step 724, the system determines a maximum period for the quasi-periodic near-field noise signal "Td_max" based on historical data. Maximum period "Td_max" can be based on a pre-determined number of historical periods or pulses. For example, "Td_max" can be a variable that stores the largest period detected so far, e.g., in any of the previous iterations of method 700.

At step 726, the system stores the current buffer in a cache, which can be a memory space allocated within memory 1016. The system can be configured to cache the entire contents of the stream buffer, or only a portion thereof. For example, the system can be configured to store one pulse or one period of a quasi-periodic signal in each entry in the cache. Each entry in the cache can be considered a "model sample" of a single period of the near-field noise signal, which may correspond to a single pulse of a forced-air type of in-mask alert. For example, the system can be configured to use one period worth of the current buffer where the trigger signal has a high value ("1") so that a single period of the quasi-periodic signal is stored as one model sample. The cached model samples are stored for use when the quasi-periodic signal enters a fade condition and cannot be readily obtained from the input stream as described below. Each model sample in the cache can be stored at a normalized amplitude, and the appropriate gain can be applied when generating the replica signal from cached model samples at step 728. Model samples can be stored in the cache in any suitable format known in the art, such as analog or digital formats, time-domain or frequency-domain, in compressed or uncompressed formats, and so on.

At step 728, the system generates a replica signal that replicates the detected quasi-periodic near-field noise signal. The replica signal can be generated to have a period equal to the average detected period ("Td") or, alternatively, the maximum detected period ("Td_max"). For example, the maximum detected period ("Td_max") can be used when a fade condition has been detected, as described below. The replica signal can include one or more samples of the detected quasi-periodic near-field noise signal. For example, the replica signal can be generated as a train of samples of pulses from an in-mask alert, with a timing between samples determined by the average detected period or maximum detected period. When a quasi-periodic near-field noise signal is present in the input audio stream and not in the fade condition, then the samples can be obtained from the stream buffer. When the system is in the detected mode, but the quasi-periodic near-field noise signal is in the fade condition, model samples can be obtained from the cache. Thus, the system is able to generate a replica signal that substantially replicates a near-field noise signal even when the near-field noise signal is itself obscured by near-field speech or other noise. The system controls at least one characteristic of the replica signal so that the near-field noise signal will be recognized as far-field noise when the input stream and the replica signal are processed by a far-field noise cancellation device. For example, as described above with reference to FIGS. 3-5, the system can control the amplitude of the replica signal such that it substantially matches the amplitude of near-field noise signal 206. The system can be configured to detect the amplitude of a current near-field noise pulse using peak detection, and apply a gain to a model sample retrieved from the cache such that the replica signal will have substantially the same amplitude. It will be understood that the replica signal generated at step 728 can be generated continuously over multiple iterations of method 700.

At step 730 the system determines whether a fade condition exists. The system can be configured to execute steps 704-718 during step 730, or in parallel (as a concurrent thread or process) with any of steps 720-734. A fade condition can be detected when the system is in detected mode but fails to detect a quasi-periodic signal in the input stream (e.g., at step 710). For example, if speech is present in the input audio stream, then the correlation envelope value may be high despite the presence of a quasi-periodic signal. This is because speech generally exhibits a high auto-correlation value. Thus, speech can hinder the detection of a quasi-periodic signal. The same can be true of noise. When the quasi-periodic near-field noise signal is obscured, (by speech or other noise), then the quasi-periodic signal can be considered in a fade condition. If a fade condition is detected, then flow proceeds to step 732. If a fade condition is not detected, then flow proceeds to step 728 for further generation of the replica signal.

At step 732, the system retrieves a model sample from the cache. Model samples can be retrieved from the cache on a First-In, First-Out ("FIFO") basis, or on a Last-In, First-Out ("LIFO") basis, as mere examples.

At step 734, the system determines whether a fade timeout threshold has been reached for the fade condition. If the near-field noise signal remains in the fade for a sufficient period of time, then the system will timeout and exit the detected mode. The fade timeout threshold can be a predetermined value, such as a user-supplied value. The fade timeout threshold can be set such that if the quasi-periodic signal is, in fact, present in the input signal notwithstanding the fade condition, it will be re-acquired before the fade timeout occurs.

Step 798 is the end of method 700, or the end of one iteration of method 700. It should be noted that method 700 can be repeated in a continuous loop. For example, method 700 can be executed repeatedly by a signal processor at predefined intervals, such as 100 times per second. It should be noted that method 700 can be implemented in multiple parallel processes or threads. For example, the system can be configured to perform steps 704-718 in a loop in parallel with steps 720-734.

Exemplary Communications Device Implementing Method 100

Referring now to FIGS. 8-9, there are provided front and back perspective views of an exemplary communication device 800 implementing method 600 of FIG. 6. The communication device 800 can be, but is not limited to, a radio, a mobile phone, a cellular phone, or other wireless communication device.

According to embodiments of the present invention, communication device 800 is a land mobile radio system intended for use by terrestrial users in vehicles (mobiles) or on foot (portables). As shown in FIGS. 8-9, the communication device 800 comprises a primary microphone 120 disposed on a front surface 804 thereof and a secondary microphone 122 disposed on a back surface 904 thereof. For example, the microphones 120, 122 can be arranged on the surfaces 804, 904 so as to be in approximate alignment with respect to each other. Still, the invention is not limited in this regard and other microphone positions are also possible. The first and second microphones 120, 122 are placed at locations on surfaces 804, 904 of the communication device 800 that are advantageous to noise cancellation. In this regard, it should be understood that the microphones 120, 122 are preferably located on surfaces 804, 904 such that they output approximately the same signal when receiving far field sound. For example, if the microphones 120 and 122 are spaced four (4) inches from each other, then sound emanating from a source located six (6) feet from the communication device 800 will exhibit a power (or intensity) difference between the microphones 120, 122 of less than half a decibel (0.5 dB).

The microphones 120, 122 are also located on surfaces 804, 904 such that microphone 120 has a higher level signal than the microphone 122 when detecting near field sound. For example, the microphones 120, 122 can be located on surfaces 804, 904 such that they are spaced four (4) inches from each other. If sound is emanating from a source located one (1) inch from the microphone 120 and four (4) inches from the microphone 122, then a difference between power (or intensity) of a signal representing the sound and generated at the microphones 120, 122 is approximately twelve decibels (12 dB). Embodiments of the present invention are not limited in this regard.

Figure 10:
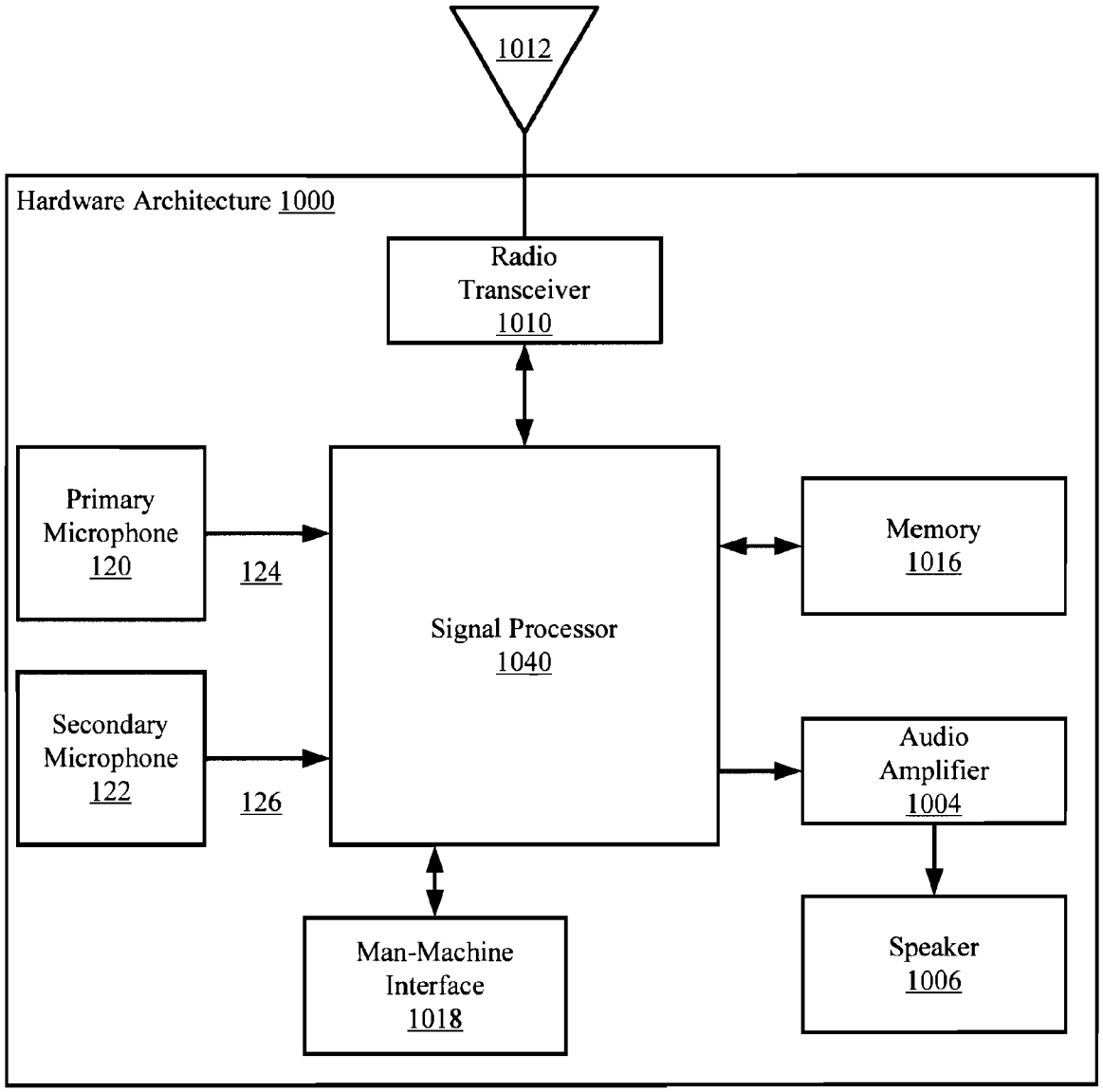
FIG. 10 is a block diagram illustrating an exemplary hardware architecture of the communication device shown in FIGS. 8-9 that is useful for understanding the present invention.

Referring now to FIG. 10, there is provided a block diagram of an exemplary hardware architecture 1000 of the communication device 800. As shown in FIG. 10, the hardware architecture 1000 comprises the primary microphone 120 and the secondary microphone 122. The hardware architecture 1000 also comprises audio amplifier 1004, a speaker 1006, a radio transceiver 1010, an antenna element 1012, and a Man-Machine Interface (MMI) 1018. The MMI 1018 can include, but is not limited to, radio controls, on/off switches or buttons, a keypad, a display device, and a volume control. The hardware architecture 1000 is further comprised of a signal processor 1040, which can be signal processor 340, 440, or 540. Signal processor 1040 can comprise a Digital Signal Processor (DSP). The hardware architecture 1000 can also include a memory device 1016 for the use by the signal processor 1040.

The transceiver 1010 is generally a unit which contains both a receiver (not shown) and a transmitter (not shown). Accordingly, the transceiver 1010 is configured to communicate signals to the antenna element 1012 for communication to a base station, a communication center, or another communication device 800. The transceiver 1010 is also configured to receive signals from the antenna element 1012.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature can be combined with one or more other features of the other implementations as can be desired and advantageous for any given or particular application.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

I claim:

1. A method for reducing an interference of a near-field noise signal with a select near-field sound, the method comprising:

receiving, from a first acoustic sensing device, a first electronic signal comprising the select near-field sound signal and the near-field noise signal including near-field noise originating from at least one first sound source located relatively proximal to the first acoustic sensing device as compared to a second sound source from which a far-field noise originates;

analyzing the first electronic signal to detect the near-field noise signal based on a known recognizable acoustic signature or pattern of the first sound source which was known prior to the near-field noise's origination;

generating a replica signal when a presence of the near-field noise signal is detected within the first electronic signal, where the replica signal is a replica of the near-field noise signal;

controlling at least one characteristic of the replica signal so as to cause a far-field noise cancellation process to consider the corresponding near-field noise as constituting far-field noise;

communicating said replica signal to a first input of a far-field noise cancellation process and said first electronic signal to a second input of the far-field noise cancellation process, where the far-field noise cancellation process is designed to cancel far-field noise from audio signals while preserving near-field sound; and generating an output signal of said far-field noise cancellation process in which said near-field noise signal is reduced in amplitude whereby the interference thereof with the select near-field sound signal is also reduced.

2. The method according to claim 1, further comprising:

receiving an electronic trigger signal for said near-field noise signal; and controlling a timing of said replica signal based on said electronic trigger signal.

3. The method according to claim 1, wherein said first electronic signal further includes a speech signal originating in a near field of said first acoustic sensing device, and said far-field noise cancellation process preserves said speech signal in said output signal.

4. The method according to claim 3, further comprising:

receiving, from a second acoustic sensing device, a second electronic signal; and prior to said communicating step, adding said second electronic signal to said replica signal;

wherein said speech signal is also included in said second electronic signal in a form that is attenuated relative to said speech signal in said first electronic signal.

5. The method according to claim 4, wherein said first electronic signal and said second electronic signal include a far-field noise signal, and wherein said far-field noise signal is substantially reduced in said output signal.

6. The method according to claim 1, wherein a timing of said replica signal is controlled.

7. The method according to claim 6, wherein a periodicity of said replica signal is controlled.

8. The method according to claim 1, wherein said near-field noise signal is produced by pulsating an air flow in an SCBA mask.

9. The method according to claim 1, wherein said near-field noise signal is a quasi-periodic signal.

10. The method according to claim 1, wherein said analyzing step comprises comparing said near-field noise signal to stored information concerning a model near-field noise signal.

11. A communications device comprising:

a first acoustic sensing device configured to receive acoustic signals and generate a first electronic signal based on said acoustic signals;

a far field noise cancellation device comprising a primary input and a secondary input, and configured to reduce interference of received near-field noise signals identified as far-field noise with select near-field sound signals; and at least one electronic circuit configured to:

receive, from said first acoustic sensing device, said first electronic signal comprising a select near-field sound signal and a near-field noise signal including near-field noise originating from at least one first sound source located relatively proximal to the first acoustic sensing device as compared to a second sound source from which a far-field noise originates;

analyze the first electronic signal to detect the near-field noise signal based on a known recognizable acoustic signature or pattern of the first sound source which was known prior to the near-field noise's origination;

generating a replica signal when a presence of the near-field noise signal is detected within the first electronic signal, where the replica signal is a replica of the near-field noise signal;

control at least one characteristic of said replica signal so as to cause said far-field noise cancellation device to consider said near-field noise signal as constituting far-field noise; and communicate said first electronic signal to said primary input and said replica signal to said secondary input of said far-field noise cancellation device.

12. The communications device according to claim 11, wherein said electronic circuit is further configured to:

receive an electronic trigger signal for said near-field noise signal; and generate said replica signal based on said electronic trigger signal.

13. The communications device according to claim 11, wherein said first electronic signal includes an electronic representation of a speech signal originating in a near field of said first acoustic sensing device, and said far-field noise cancellation device is further configured to generate an output signal that includes said speech signal.

14. The communications device according to claim 13, wherein said electronic circuit is further configured to:

receive, from a second acoustic sensing device, a second electronic signal comprising said speech signal in a form that is attenuated relative to said speech signal in said first electronic signal; and prior to said communicating step, adding said second electronic signal to said replica signal.

15. The communications device according to claim 14, wherein said first electronic signal and said second electronic signal include an electronic representation of a far-field noise signal originating in a far field of said first and said second acoustic sensing devices, and wherein said far-field noise signal is substantially reduced in said output signal.

16. The communications device according to claim 11, wherein said electronic circuit is further configured to control a timing of said replica signal.

17. The communications device according to claim 11, wherein said electronic circuit is further configured to control a periodicity of said replica signal.

18. The communications device according to claim 11, wherein said near-field noise signal is produced by pulsating an air flow in an SCBA mask.

19. The communications device according to claim 11, wherein said near-field noise signal is a quasi-periodic signal.

20. The communications device according to claim 11, wherein said electronic circuit is configured to identify the presence of said near-field noise signal in said first electronic signal by comparing said near-field noise signal to stored information concerning a model near-field noise signal.

21. A device comprising a non-transitory computer-readable storage medium, having stored thereon a computer program for reducing an interference of a near-field noise signal with a select near-field sound signal, the computer program having a plurality of code sections, the code sections executable by a computing device to cause the computing device to perform the steps of:

receiving, from a first acoustic sensing device, a first electronic signal comprising the select near-field sound signal and the near-field noise signal including near-field noise originating from at least one first sound source located relatively proximal to the first acoustic sensing device as compared to a second sound source from which a far-field noise originates;

analyzing the first electronic signal to detect the near-field noise signal based on a known recognizable acoustic signature or pattern of the first sound source which was known prior to the near-field noise's origination;

generating a replica signal when a presence of the near-field noise signal is detected within the first electronic signal, where the replica signal is a replica of the near-field noise signal;

controlling at least one characteristic of the replica signal so as to cause a far-field noise cancellation process to consider the corresponding near-field noise as constituting far-field noise;

communicating said replica signal to a first input of a far-field noise cancellation process and said first electronic signal to a second input of the far-field noise cancellation process, where the far-field noise cancellation process is designed to cancel far-field noise from audio signals while preserving near-field sound; and generating an output signal of said far-field noise cancellation process in which said near-field noise signal is reduced in amplitude whereby the interference thereof with the select near-field sound signal is also reduced.

* * * * *